US008577278B2

(12) United States Patent
Inoue

(10) Patent No.: US 8,577,278 B2
(45) Date of Patent: Nov. 5, 2013

(54) IMAGE FORMING APPARATUS TO FORM IMAGES ON SHEETS UTILIZING DETECTED SHEET SLIDE POSITIONS

(75) Inventor: Kozo Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 941 days.

(21) Appl. No.: 12/143,554

(22) Filed: Jun. 20, 2008

(65) Prior Publication Data

US 2008/0317533 A1 Dec. 25, 2008

(30) Foreign Application Priority Data

Jun. 22, 2007 (JP) ..... 2007-165227

(51) Int. Cl.
*G03G 15/00* (2006.01)

(52) U.S. Cl.
USPC ..... 399/401; 399/394; 399/395

(58) Field of Classification Search
USPC ..... 399/401, 394, 395
See application file for complete search history.

(56) References Cited

U.S. PATENT DOCUMENTS

| | | | | |
|---|---|---|---|---|
| 6,019,365 | A * | 2/2000 | Matsumura | 271/227 |
| 6,511,239 | B1 * | 1/2003 | Kretschmann et al. | 400/579 |
| 6,834,176 | B2 * | 12/2004 | Saito et al. | 399/302 |
| 7,062,217 | B2 * | 6/2006 | Tsukamoto et al. | 399/401 |
| 2006/0099019 | A1 * | 5/2006 | Howe | 399/395 |

FOREIGN PATENT DOCUMENTS

| | | | |
|---|---|---|---|
| JP | 61-275774 | A | 12/1986 |
| JP | 2002-80144 | A | 3/2002 |
| JP | 2007-011183 | A | 1/2007 |

* cited by examiner

*Primary Examiner* — Matthew G Marini
(74) *Attorney, Agent, or Firm* — Canon USA, Inc., IP Division

(57) ABSTRACT

When an image is formed on a second side of a sheet, the image forming position is adjusted on the basis of a value calculated using the amount $\alpha_n$ of lateral registration deviation detected before forming an image on the first side and the amount $\gamma_{n-1}$, of lateral registration deviation of the previous sheet on which image formation is performed. Thus, it is possible to adjust the positions of irradiation of laser light to the photosensitive drums and to start forming the second-side images as soon as the first-side images have been primary-transferred onto the intermediate transfer belt.

7 Claims, 9 Drawing Sheets

FIG. 3 nTH SHEET OF JOB ($n \neq 1$)

| | |
|---|---|
| AMOUNT OF LATERAL REGISTRATION DEVIATION OF FIRST SIDE DETECTED BY LATERAL REGISTRATION DETECTING PORTION 700 | $\alpha n$ |
| AMOUNT OF LATERAL REGISTRATION DEVIATION OF SECOND SIDE DETECTED BY LATERAL REGISTRATION DETECTING PORTION 700 | $\beta n$ |
| AMOUNT OF LATERAL REGISTRATION DEVIATION OF SECOND SIDE RELATIVE TO FIRST SIDE | $\gamma n = \beta n - \alpha n$ |
| VALUE OF AMOUNT OF LATERAL REGISTRATION DEVIATION COMPUTED BY CONTROL PORTION | $\beta' n = \alpha n + \gamma n - 1$ |

LAST SHEET OF PREVIOUS JOB

| | |
|---|---|
| AMOUNT OF LATERAL REGISTRATION DEVIATION OF FIRST SIDE DETECTED BY LATERAL REGISTRATION DETECTING PORTION 700 | $\alpha L$ |
| AMOUNT OF LATERAL REGISTRATION DEVIATION OF SECOND SIDE DETECTED BY LATERAL REGISTRATION DETECTING PORTION 700 | $\beta L$ |
| AMOUNT OF LATERAL REGISTRATION DEVIATION OF SECOND SIDE RELATIVE TO FIRST SIDE | $\gamma L = \beta L - \alpha L$ |

FIRST SHEET OF JOB

| | |
|---|---|
| AMOUNT OF LATERAL REGISTRATION DEVIATION OF FIRST SIDE DETECTED BY LATERAL REGISTRATION DETECTING PORTION 700 | $\alpha 1$ |
| VALUE OF AMOUNT OF LATERAL REGISTRATION DEVIATION COMPUTED BY CONTROL PORTION | $\beta' 1 = \alpha 1 + \gamma L$ |

IMAGE FORMING APPARATUS TO FORM IMAGES ON SHEETS UTILIZING DETECTED SHEET SLIDE POSITIONS

BACKGROUND OF THE INVENTION

1. Field of the Invention

The present invention relates to image forming apparatuses such as copying machines and printers.

2. Description of the Related Art

In some image forming apparatuses, the image forming position can be adjusted in a direction perpendicular to the sheet conveying direction so that an image forming portion can form an image in the center in the width direction of a sheet. In these image forming apparatuses, the position in a direction perpendicular to the conveying direction of a sheet coming to the image forming portion is detected before image formation on the sheet by a sheet position detecting device installed in the main body of the image forming apparatus, and on the basis of the detection information, the image forming position is adjusted. By thus adjusting the image forming position according to the position of the coming sheet, an image can be formed at an appropriate position relative to the sheet.

In recent years, color image forming apparatuses employing various image forming technologies have been proposed. One of the technologies is an image forming technology using an intermediate transfer belt in an electrophotography technology. In this technology, an image unit is provided for each color of developer. In these image units, their respective colors of toner images are formed on their respective photosensitive drums through a known image forming process. These toner images are transferred (primary-transferred) sequentially onto an intermediate transfer belt. The toner images transferred onto the intermediate transfer belt 31 are transferred (secondary-transferred) together onto a coming sheet. The toner images transferred onto the sheet are fixed in a fixing device. In this way, image formation is performed on the sheet. In this type of image forming apparatus, the image units sequentially form their respective colors of images, which are superposed over one another and thereafter transferred onto a sheet. Therefore, the productivity of image formation can be improved.

FIG. 9 shows a color image forming apparatus employing this image forming technology using an intermediate transfer belt. The structure and image forming operation thereof will be briefly described. This color image forming apparatus includes an image unit 10, a paper feed unit 20, an intermediate transfer unit 30, and a fixing unit 40.

The image unit 10 includes four structurally identical stations, which are tandemly arranged. The stations include photosensitive drums 11*a*, 11*b*, 11*c*, and 11*d*, respectively, and primary charging devices 12*a*, 12*b*, 12*c*, and 12*d*, respectively. In addition, the stations include optical systems 13*a*, 13*b*, 13*c*, and 13*d*, respectively, developing devices 14*a*, 14*b*, 14*c*, and 14*d*, respectively, and cleaning devices 15*a*, 15*b*, 15*c*, and 15*d*, respectively.

The photosensitive drums 11*a* to 11*d*, which serve as image bearing members, are rotationally driven in the directions of arrows in the figure. The intermediate transfer unit 30 has an intermediate transfer belt 31, which serves as an intermediate transfer member. The upper portion of the intermediate transfer belt 31 forms a primary transfer plane A that can come into contact with the photosensitive drums 11*a* to 11*d*. As for the lower portion of the intermediate transfer belt 31, a secondary transfer internal roller 34 and a secondary transfer device 36 are disposed opposite each other with the intermediate transfer belt 31 therebetween and form a secondary transfer region Te.

The operation of this structure will be outlined. The primary charging devices 12*a* to 12*d* uniformly charge the surfaces of the photosensitive drums 11*a* to 11*d*, respectively. The photosensitive drums 11*a* to 11*d* are irradiated with and exposed to laser beams that are modulated according to a record image signal by the optical systems 13*a* to 13*d*. In this way, electrostatic latent images are formed on the photosensitive drums 11*a* to 11*d*. The electrostatic latent images are visualized into toner images on the surfaces of the photosensitive drums 11*a* to 11*d* by the developing devices 14*a* to 14*d*, which store yellow, cyan, magenta, and black developers (toners), respectively.

Thereafter, the toner images visualized on the surfaces of the photosensitive drums 11*a* to 11*d* are transferred onto the intermediate transfer belt 31 in primary transfer regions Ta, Tb, Tc, and Td. Toner not transferred onto a sheet P but left on the photosensitive drums 11*a* to 11*d* is scraped off by the cleaning devices 15*a*, 15*b*, 15*c*, and 15*d*. In this way, the surfaces of the photosensitive drums 11*a* to 11*d* are cleaned.

The toner images on the surfaces of the photosensitive drums 11*a* to 11*d* are transferred (primary-transferred) sequentially onto the intermediate transfer belt 31 rotating in the direction of arrow B, and the toner images of each color are superposed over one another on the intermediate transfer belt 31. In timed relationship with the image formation in the image unit 10, the sheet P sent out from the paper cassette 21*a* or 21*b* of the paper feed unit 20 is conveyed to the secondary transfer region Te, and the toner images on the intermediate transfer belt 31 are transferred (secondary-transferred) together onto the coming sheet. The toner images transferred onto the sheet P are fixed in the fixing unit 40. The sheet P is ejected by an external eject roller 45 onto a paper output tray 48.

In this color image forming apparatus employing the image forming technology using an intermediate transfer belt, when images are formed on both sides of a sheet, a sheet on a first side of which an image is formed is reversed by the external eject roller 45 serving as a reversing portion and is again conveyed to the secondary transfer region Te via a double-sided path 240. Thus, an image can also be formed on a second side of the sheet (the first side on which an image is formed will be referred to as first side, and the other side will be referred to as second side). In this way, images are formed on both sides of the sheet.

For example, when a plurality of sheets on both sides of which images are formed are bound to make a book, a significant difference in the position of images relative to each sheet between one side and the other side deteriorates the quality. Therefore, it is desired that the positions of images on the first and second sides relative to each sheet are identical to each other.

However, when images are formed on both sides of a sheet, the positions of the side edges (both edges along the sheet conveying direction) of the sheet being conveyed to the secondary transfer region Te to form an image on the second side of the sheet are significantly affected by the sheet reversing operation of the external eject roller 45. That is, the positions of the side edges of the sheet after the reversal tend to differ from those before the reversal. Therefore, it is necessary to detect the positions of the side edges (hereinafter referred to as side edge positions) of the sheet after the reversal and to adjust, on the basis of the detection, the position of an image to be formed on the sheet in a direction perpendicular to the sheet conveying direction. That is, after an image is formed on the first side and before an image is formed on the second side, the image position is adjusted by detecting the side edge positions of the sheet, obtaining the amount of deviation from reference positions, and, according to this amount of deviation, changing the timing of irradiation to the photosensitive drums 11*a* to 11*d* by the optical systems 13*a* to 13*d*. The term "changing the timing of irradiation" is defined as changing the irradiation start positions on the photosensitive drums 11*a* to 11*d* in the main scanning direction from which irradiation of laser light from the optical systems 13*a* to 13*d* is started.

However, in the image forming technology using an intermediate transfer belt, the distance from the irradiation position where the optical system 13*d* irradiates the photosensitive drum 11*d* to the secondary transfer region Te is long, and therefore the image forming process operation from the start of image formation to the transfer (secondary transfer) of toner images onto a sheet takes long time. Therefore, when the side edge positions of a sheet on the second side of which an image is to be formed are detected before the secondary transfer region Te and thereafter the image position in the image forming portion is adjusted, the sheet needs to be kept stopped for a long time until the transfer. Therefore, the productivity in image formation (the number of images formed on sheets per unit time) is significantly reduced. Therefore, it is necessary to detect as soon as possible the side edge positions of a sheet on the second side of which an image is to be formed, in order to start as soon as possible the image forming operation. For this purpose, as shown in FIG. 9, an edge detecting sensor 800 for detecting the side edge positions of a sheet on the second side of which an image is to be formed is provided downstream of the reversing portion and upstream of the double-sided path 240, thereby improving the productivity during two-sided image formation. This technology is disclosed in Japanese Patent Laid-Open No. 2002-80144.

However, in recent years, it has been strongly desired that image forming apparatuses have high productivity. In the above-described image forming apparatus, the edges of a sheet are detected by the edge detecting sensor 800 provided in the double-sided path 240, and thereafter adjustment of the image position in the image forming portion is started. Therefore, the productivity can be improved to some extent but is not sufficient.

That is, the edge detecting sensor 800 needs to be provided downstream, in the sheet conveying direction, of the sheet reversing portion, which significantly affects the position of the sheet. On the basis of the detection, the image forming operation in the image forming portion is started. Therefore, the productivity of image formation is significantly limited by the position where the edge detecting sensor 800 is disposed. Therefore, conventional apparatuses cannot sufficiently meet the demands for high productivity.

SUMMARY OF THE INVENTION

The present invention is directed to achieving higher productivity in an image forming apparatus in which the image forming process in the image forming portion takes long time.

In an aspect of the present invention, an image forming apparatus that forms an image on a sheet includes an image forming portion, a sheet feeding portion, a sheet re-conveying portion, an edge position detecting unit, and a control portion. The image forming portion forms an image on a sheet. The sheet feeding portion feeds a sheet from a sheet storing portion that stores sheets, to the image forming portion. The sheet re-conveying portion conveys a sheet on a first side of which an image has been formed in the image forming portion, to the image forming portion in order to form an image on a second side of the sheet. The edge position detecting unit can detect a side edge position along the sheet conveying direction of a sheet conveyed to the image forming portion by the sheet feeding portion and the sheet re-conveying portion. The control portion adjusts the position of an image to be formed on a second side of a second sheet by the image forming portion, after images are formed on a first side and a second side of a first sheet, on the basis of a side edge position of the first sheet fed by the sheet feeding portion and a side edge position of the first sheet conveyed by the sheet re-conveying portion detected by the edge position detecting unit.

Further features of the present invention will become apparent from the following description of exemplary embodiments with reference to the attached drawings.

BRIEF DESCRIPTION OF THE DRAWINGS

FIG. 3 illustrates the detected amount of lateral registration deviation and the computed value.

DESCRIPTION OF THE EMBODIMENTS

First, an image forming apparatus according to an embodiment of the present invention will be described in detail with reference to FIGS. 1 to 5.

Figure 1:
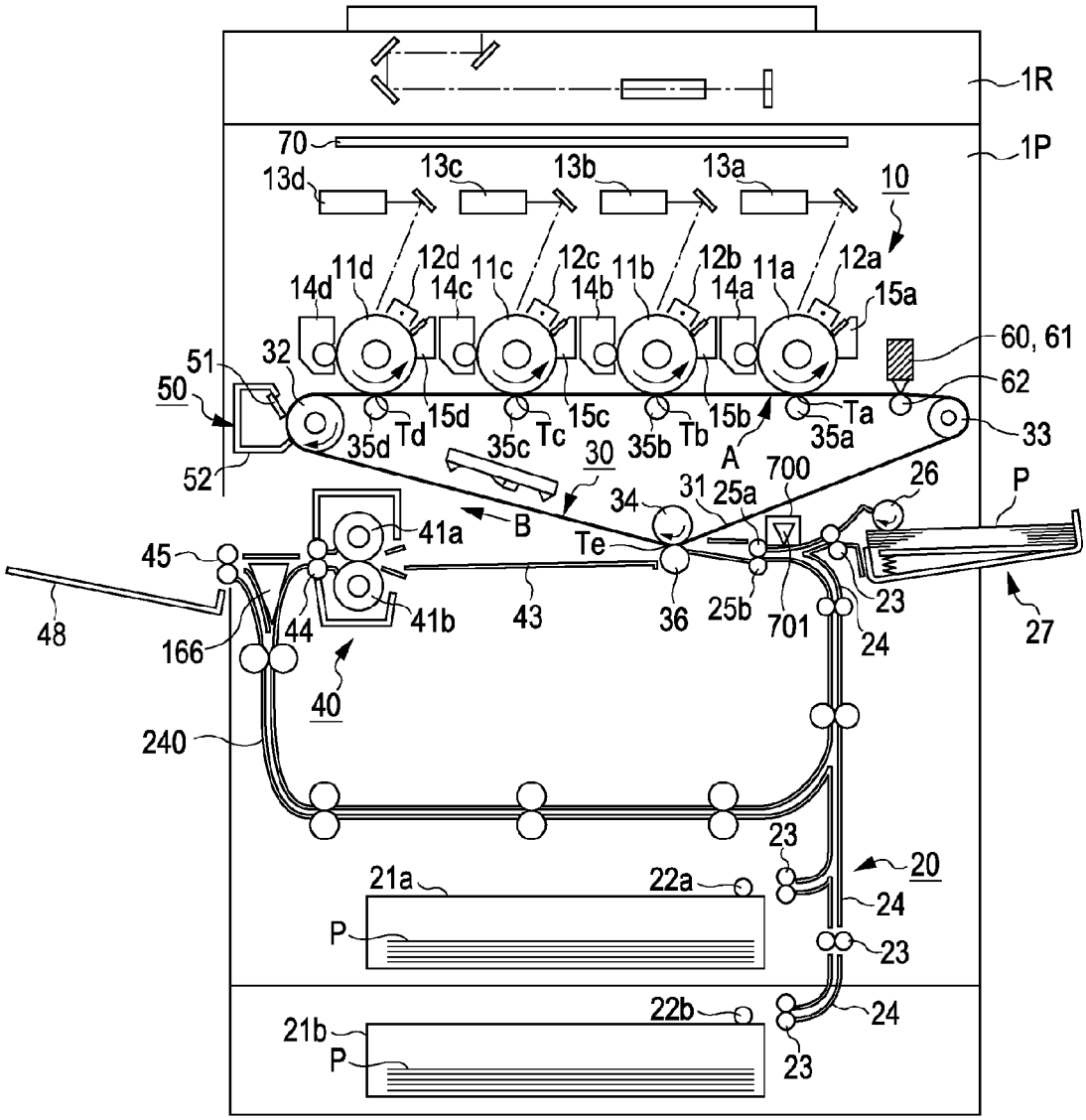
FIG. 1 is a schematic sectional view of an image forming apparatus according to an embodiment of the present invention.

FIG. 1 is a schematic sectional view of the image forming apparatus of this embodiment. The shown image forming apparatus is a color image forming apparatus including a plurality of stations arranged tandemly. On the top of the image forming apparatus is attached an image reading device 1R for reading an image, for example, of a document. This image forming apparatus is configured to again convey a sheet on a first side of which an image is formed to the image forming portion so that images can be formed on both sides of the sheet.

The color image forming apparatus is provided with an image forming portion 1P, which mainly includes an image unit 10, an intermediate transfer unit 30, and a fixing unit 40. The image unit 10 includes four structurally identical stations, which are tandemly arranged. The stations includes photosensitive drums 11*a*, 11*b*, 11*c*, and 11*d*, respectively, which are supported by means of shafts so as to be able to be rotationally driven by a drum drive source. Around the photosensitive drums 11*a* to 11*d* and in the rotational direction thereof are sequentially disposed primary charging devices 12*a*, 12*b*, 12*c*, and 12*d*, respectively, optical systems 13*a*, 13*b*, 13*c*, and 13*d*, respectively, and developing devices 14*a*, 14*b*, 14*c*, and 14*d*, respectively.

The primary charging devices 12*a* to 12*d* uniformly charge the surfaces of the photosensitive drums 11*a* to 11*d*, respectively. The photosensitive drums 11*a* to 11*d* are irradiated with and exposed to, for example, laser beams that are modulated according to a record image signal by the optical systems 13*a* to 13*d*. In this way, electrostatic latent images are formed on the photosensitive drums 11*a* to 11*d*. The record image signal is a signal based on the image information, for example, of a document read with the image reading device 1R provided on the top or the image information sent from a not shown computer.

The electrostatic latent images are visualized into toner images on the surfaces of the photosensitive drums 11*a* to 11*d* by the developing devices 14*a* to 14*d*, which store yellow, cyan, magenta, and black developers (toners), respectively. At the positions on the inner surface of the intermediate transfer belt 31 corresponding to the photosensitive drums 11*a* to 11*d* of the stations are disposed primary transfer rollers 35*a*, 35*b*, 35*c*, and 35*d*, respectively, which constitute primary transfer regions Ta, Tb, Tc, and Td, respectively, where visualized toner images are transferred onto the intermediate transfer belt 31.

In the primary transfer regions Ta to Td, toner not transferred onto a sheet P but left on the photosensitive drums 11*a* to 11*d* is scraped off by the cleaning devices 15*a*, 15*b*, 15*c*, and 15*d*.

Through the above-described process, image formation using each toner is sequentially performed in the image unit 10.

The intermediate transfer unit 30 has an intermediate transfer belt 31, which serves as an intermediate transfer member. The intermediate transfer belt 31 is stretched around a driving roller 32, a backup roller 62, a tension roller 33, and a secondary transfer internal roller 34. The upper portion of the intermediate transfer belt 31 forms a primary transfer plane A that can come into contact with the photosensitive drums 11*a* to 11*d*. The intermediate transfer belt 31 is formed, for example, of PI (polyimide) or PVdF (polyvinylidene-fluoride).

The driving roller 32 is provided for transmitting driving force from an intermediate transfer belt drive source, such as a pulse motor, to the intermediate transfer belt 31 and thereby rotating the intermediate transfer belt 31 in the direction of arrow B in the figure. This driving roller 32 is a metal roller coated with a several millimeters thick coating of (urethane or chloroprene) rubber so as to prevent the intermediate transfer belt 31 from slipping. The backup roller 62 is provided opposite the registration mark detecting sensors 60 and 61. The registration mark detecting sensors 60 and 61 detect a registration mark for adjusting the positions of toner images primary-transferred onto the intermediate transfer belt 31 from the photosensitive drums 11*a* to 11*d*. The backup roller 62 performs backup when the registration mark detecting sensors 60 and 61 detect the registration mark.

The tension roller 33 tightens the intermediate transfer belt 31 to an appropriate degree by an urging force of a not shown spring so that alignment can be adjusted and the meandering of the intermediate transfer belt 31 can be corrected. The secondary transfer internal roller 34 and a secondary transfer device 36 are disposed opposite each other with the lower portion of the intermediate transfer belt 31 therebetween and form a secondary transfer region Te.

On the intermediate transfer belt 31 and downstream of the secondary transfer region Te is disposed a cleaning device 50 for cleaning the image forming surface of the intermediate transfer belt 31. This cleaning device 50 includes a cleaner blade 51 for scraping off toner left on the intermediate transfer belt 31 and a waste toner box 52 for storing waste toner scraped off. The cleaner blade 51 is formed, for example, of polyurethane rubber.

The image forming apparatus is provided with a paper feed unit 20 for feeding sheets. The paper feeding unit 20 includes paper cassettes 21*a* and 21*b* and a manual feed tray 27 serving as sheet storing portions that store sheets P. The paper feeding unit 20 also includes pickup rollers 22*a*, 22*b*, and 26 that send out sheets P from the paper cassettes 21*a* and 21*b* and the manual feed tray 27, respectively. In addition, the paper feeding unit 20 includes paper feed roller pairs 23 and a feeding path 24 serving as sheet feeding portions for feeding sheets P sent out from the pickup rollers 22*a*, 22*b*, and 26 to a registration roller pair 25*a* and 25*b*.

The registration roller pair 25*a* and 25*b* are provided for sending out a sheet P to the secondary transfer region Te in timed relationship with the image formation in the image unit 10. In addition, at a position upstream of the registration roller pair 25*a* and 25*b* in the sheet conveying direction is provided a lateral registration detecting portion 700 serving as an edge position detecting unit. This lateral registration detecting portion 700 detects the amount of lateral registration deviation of a sheet P being conveyed, that is, the amount of deviation from a reference position in the sheet width direction of the sheet P (direction perpendicular to the sheet conveying direction). The operation and control of the lateral registration detecting portion 700 will be described below in detail.

The fixing unit 40 includes a fixing roller 41*a* having a heat source such as a halogen heater therein, and a pressing roller 41*b* pressed against the fixing roller 41*a*. The pressing roller 41*b* may also have a heat source. In addition, the fixing unit 40 includes a conveyance guide 43 for guiding a sheet P to the nip portion (pressing portion) between the fixing roller 41*a* and the pressing roller 41*b*, and an internal eject roller 44 for conveying the sheet P ejected from the fixing roller 41*a* and the pressing roller 41*b* toward the outside of the apparatus.

Figure 4:
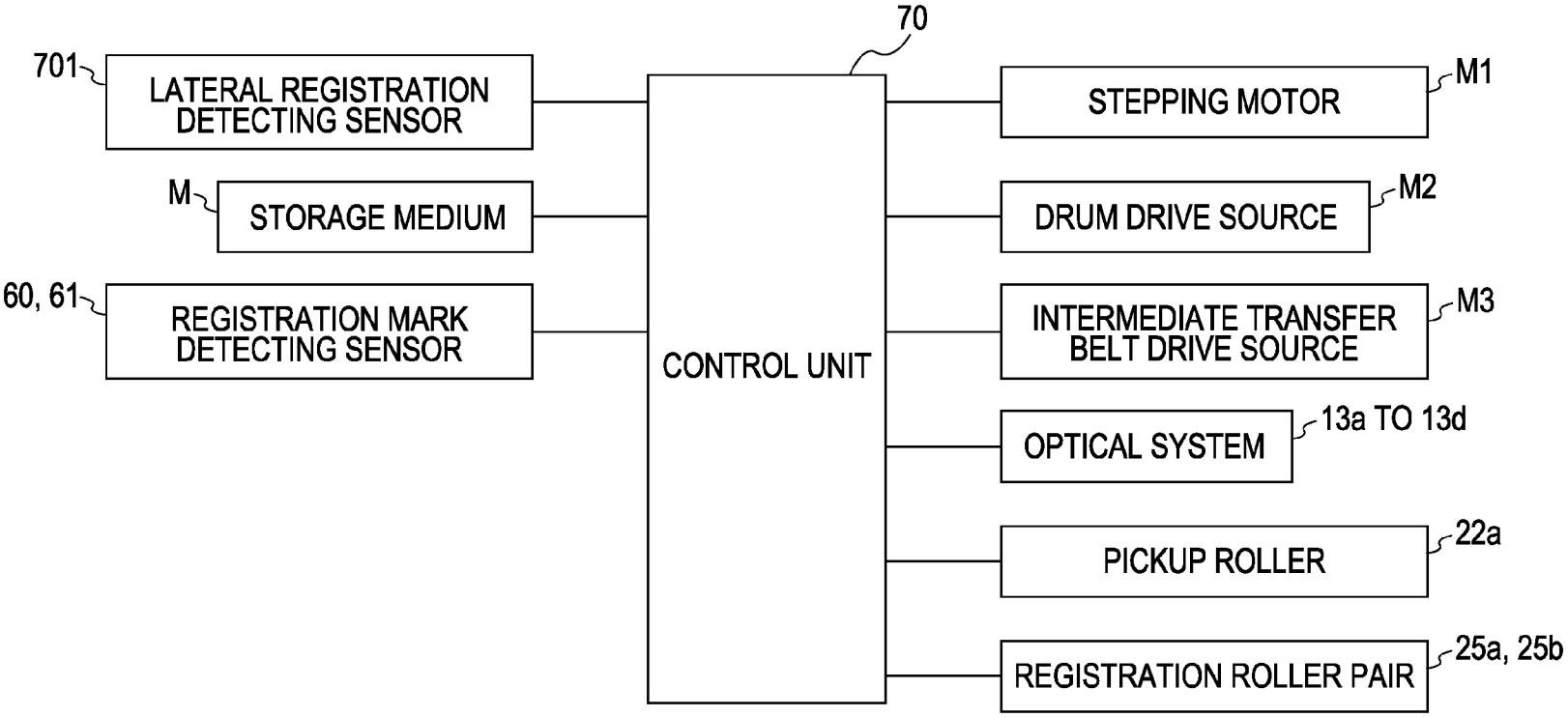
FIG. 4 is a control block diagram.

A control unit 70 serving as a control portion that controls the image forming apparatus includes a control board for controlling the operations of the above-described units and a not shown motor drive board. FIG. 4 shows a block diagram including the control unit 70. Detection signals from the lateral registration detecting sensor 701 and the registration mark detecting sensors 60 and 61 are input into the control unit 70 serving as a control portion. A storage medium M to be described below is connected to the control unit 70. On the basis of each detection signal, the control unit 70 controls the operations of the stepping motor M1, the drum drive source M2, the intermediate transfer belt drive source M3, the optical systems 13*a* to 13*d*, the pickup roller 22*a*, and the registration roller pair 25*a* and 25*b*.

Next, the operation of this color image forming apparatus will be described.

Upon input of an image forming operation start signal, first, sheets P are sent out one at a time from the paper cassette 21*a* serving as a sheet storing portion by the pickup roller 22*a*. The sheet P is guided by the paper feed roller pair 23 to the feeding path 24 serving as a sheet feeding portion and is conveyed to the registration roller pair 25*a* and 25*b*. At this time, the registration roller pair 25*a* and 25*b* are at a stop, and the leading edge of the sheet P hits against the nip portion of the registration roller pair 25*a* and 25*b*. In this way, the skew of the sheet P is corrected. Thereafter, the registration roller pair 25*a* and 25*b* start to rotate so that the position of the toner images primary-transferred onto the intermediate transfer belt 31 and the sheet P correspond with each other. That is, the rotation start timing of the registration roller pair 25*a* and 25*b* is set so that the toner images primary-transferred onto the intermediate transfer belt 31 by the image unit 10 and the sheet P correspond with each other in the secondary transfer region Te.

In the image unit 10, upon input of an image forming operation start signal, a toner image is formed on the most upstream photosensitive drum 11*d* in the rotational direction of the intermediate transfer belt 31 through the above-described image forming process. The toner image formed on the photosensitive drum 11*d* is primary-transferred onto the intermediate transfer belt 31 in the primary transfer region Td by the primary transfer roller 35*d* to which a high voltage is applied. Next, the toner image primary-transferred onto the intermediate transfer belt 31 is conveyed to the next primary transfer region Tc. Image formation is performed on the photosensitive drum 11*c* with a delay corresponding to the time it takes the toner image to be conveyed from the primary transfer region Td to the primary transfer region Tc. The next toner image is registered with and transferred onto the toner image transferred in the primary transfer region Td. Thereafter the same process is repeated. In this way, toner images in four colors are primary-transferred from the photosensitive drums 11*a* to 11*d* onto the intermediate transfer belt 31 in a superposed manner.

Thereafter, the sheet P enters the secondary transfer region Te simultaneously with the toner images on the intermediate transfer belt 31 and comes into contact with the intermediate transfer belt 31. In timed relationship with the passage of the sheet P, a high voltage is applied to the secondary transfer device 36. The toner images in four colors formed on the intermediate transfer belt 31 through the image forming process are transferred onto the surface of the sheet P. In this way, the toner images are transferred onto the intermediate transfer belt 31 by primary transfer, the toner images primary-transferred onto the intermediate transfer belt 31 are transferred onto the sheet P by secondary transfer, and the image forming process is completed.

The sheet P onto which the toner images are transferred in the secondary transfer region Te is guided to the nip portion between the fixing roller 41*a* and the pressing roller 41*b* by the conveyance guide 43. The toner images are fixed on the surface of the sheet P by the heat and nipping pressure of the roller pair 41*a* and 41*b* of the fixing unit 40.

In this image forming portion 1P, downstream of the fixing unit 40 are disposed the internal eject roller 44 and a switching flapper 166. After passing through the fixing unit 40 and the internal eject roller 44, the sheet P is selectively guided by the switching flapper 166 out of the apparatus or to a double-sided path 240 serving as a sheet re-conveying portion. The double-sided path 240 merges with the feeding path 24 upstream of the secondary transfer region Te of the image forming portion 1P.

When image formation is performed only on a first side of the sheet P, the external eject roller 45 is rotationally driven in the forward direction, and thereby the sheet P is guided out of the apparatus and ejected onto a paper output tray 48. When image formation is performed on both sides of the sheet P, the sheet P needs to be reversed. Before the trailing edge of the sheet P has left the external eject roller 45, the external eject roller 45 is rotationally driven in the reverse direction. The sheet P is reversed and guided to the double-sided path 240 by the switching flapper 166. At this time, the external eject roller 45 and the switching flapper 166 constitute a reversing portion that reverses the sheet P. The sheet P is again conveyed to the image forming portion via the double-sided path 240, the feeding path 24, and the registration roller pair 25*a* and 25*b*. Toner images are transferred onto a second side of the sheet P (the first side on which an image is formed will be referred to as first side, and the other side will be referred to as second side). Thereafter, the sheet P is ejected onto the paper output tray 48 via the conveyance guide 43, the fixing unit 40, the switching flapper 166, and the external eject roller 45.

The lateral registration detecting operation of the lateral registration detecting portion 700 serving as an edge position detecting unit will be described in detail.

Figure 2:
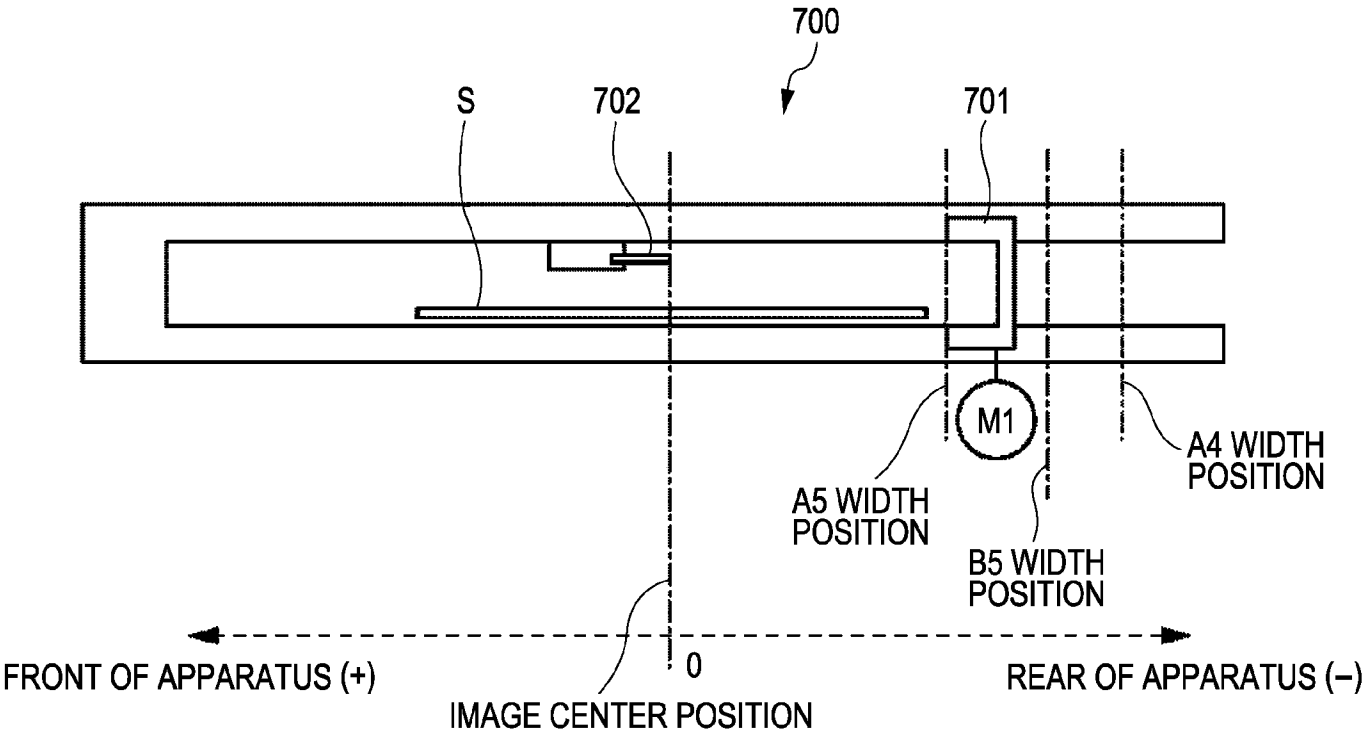
FIG. 2 is a sectional view showing the structure of the lateral registration detecting portion of FIG. 1.

The lateral registration detecting portion 700 is disposed upstream of the registration roller pair 25*a* and 25*b* and downstream of the confluence of the feeding path 24 serving as a sheet feeding portion and the double-sided path 240 serving as a sheet re-conveying portion. The lateral registration detecting portion 700 is provided so as to be able to detect the position of a side edge along the sheet conveying direction of the coming sheet. As shown in FIG. 2, the lateral registration detecting portion 700 has a lateral registration detecting sensor 701, which is a photosensor. The lateral registration detecting sensor 701 is supported movably in a direction perpendicular to the conveying direction of the sheet P, that is, the sheet-width direction (the lateral direction of FIG. 2). Moving and positioning of the lateral registration detecting sensor 701 are performed by the stepping motor M1.

Positioning of this lateral registration detecting sensor 701 is performed with reference to the position of a reference plate 702 provided at the image center position. The image center position is the center position in the sheet-width direction during image formation determined in design. The sheet is conveyed with reference to this center position (center reference conveyance). The sheet P coming from the double-sided path 240 or the paper cassettes 21*a* or 21*b* passes through the lateral registration detecting portion 700 in a direction from the face to the back of the drawing in FIG. 2.

The lateral registration detecting sensor 701 is moved by initializing operation, for example, when the switch of the image forming apparatus is turned on, to a position where the reference plate 702 is detected. The position where the lateral registration detecting sensor 701 detects the reference plate 702 is referred to as the image center position. After this initializing operation, the lateral registration detecting sensor 701 is moved to and positioned at a reference position corresponding to the width size (the size in the sheet-width direction) of the coming sheet P. The lateral registration detecting sensor 701 stands by at the reference position corresponding to the width size of the sheet P. This reference position is determined with reference to the position of the reference plate 702 in accordance with the width size of the fed sheet P. In this embodiment, as shown in FIG. 2, there are three reference positions corresponding to the width sizes of A5, B5, and A4 sheets, respectively.

The sheet P fed from the paper cassette 21*a* or 21*b* is stopped temporarily on the feeding path 24 by the registration roller pair 25*a* and 25*b*, and is thereafter conveyed to the secondary transfer region Te in timed relationship with the start of image formation. During the stoppage of the sheet P at the registration roller pair 25*a* and 25*b*, an edge of the sheet P in the sheet-width direction is detected by the lateral registration detecting sensor 701 standing by at the reference position corresponding to the width size of the sheet P.

If the lateral registration detecting sensor 701 standing by at the reference position does not detect the stopped sheet P, the lateral registration detecting sensor 701 is moved by the stepping motor M1 toward the image center position until a side edge of the sheet P in the sheet-width direction is detected. The amount of deviation from the reference position (the amount of lateral registration deviation) of the sheet P is calculated on the basis of the amount of movement of the lateral registration detecting sensor 701 (the amount of rotation (or the number of drive pulses) of the stepping motor M1) from the reference position to a position where a side edge in the sheet-width direction of the sheet P is detected. That is, from the size of the sheet and the amount of movement of the lateral registration detecting sensor 701, the amount of positional deviation of the side edge of the sheet is calculated, and the amount of deviation from the conveyance reference position of the center of the sheet is calculated.

If the lateral registration detecting sensor 701 standing by at the reference position detects the stopped sheet P, the lateral registration detecting sensor 701 is moved away from the image center position and is then stopped at a position where the sheet P is not detected. The lateral registration detecting sensor 701 is moved from the stop position toward the image center position until an edge in the sheet-width direction of the sheet P is detected. From the amount of movement of the lateral registration detecting sensor 701 (the amount of rotation (or the number of drive pulses) of the stepping motor M1) for this operation, the amount of deviation of the fed sheet P from the corresponding reference position (the amount of lateral registration deviation) is calculated.

In this embodiment, the sign convention for calculating the amount lateral registration deviation is such that the reference position corresponding to the width size of the sheet P is zero, the direction toward the right of the figure (the rear of the apparatus) is negative (−), and the direction toward the left of the figure (the front of the apparatus) is positive (+). If, for example, the sheet P is deviated from the reference position toward the rear of the apparatus by one millimeter, the value of the amount of lateral registration deviation is "−1."

Figure 5:
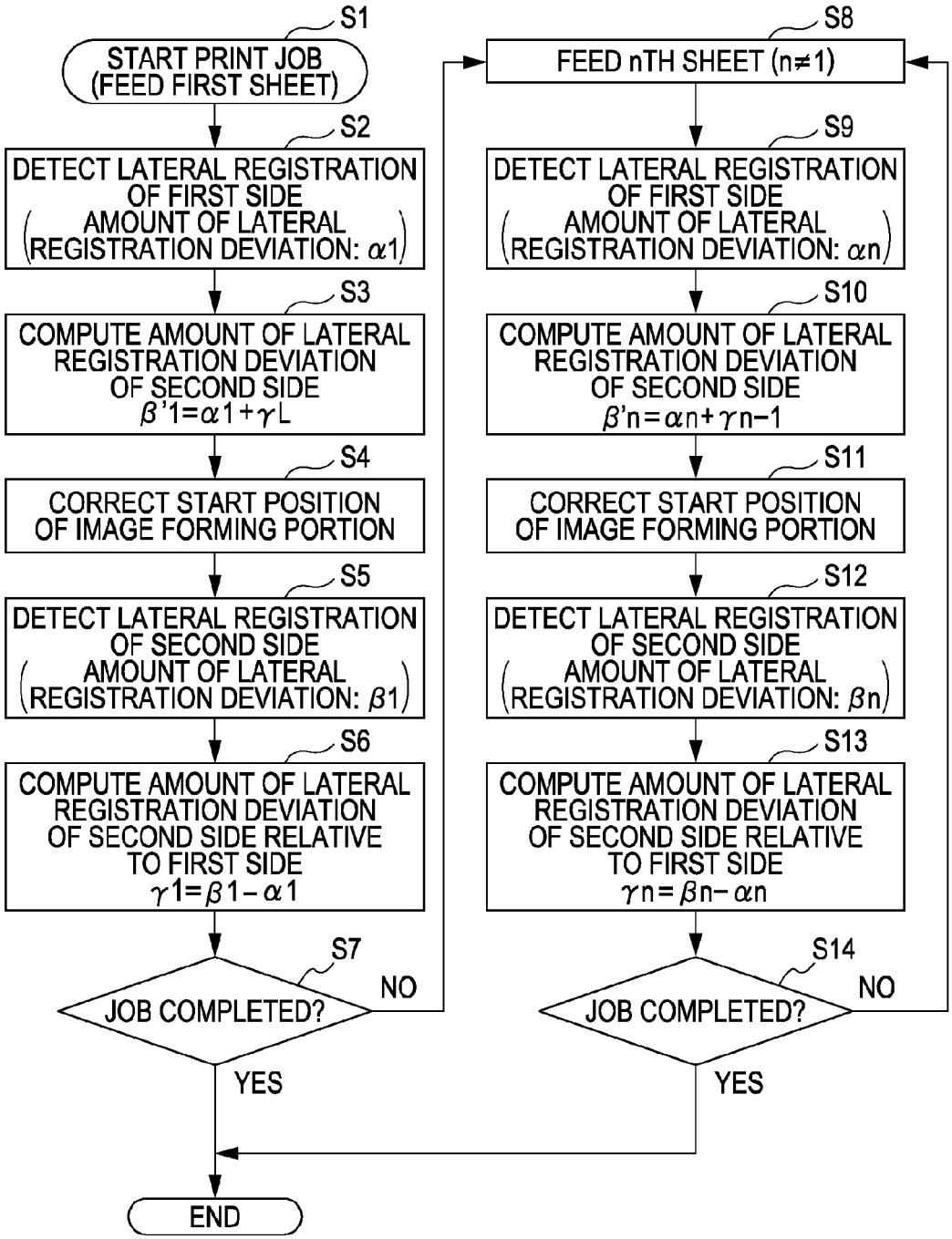
FIG. 5 is a flowchart showing how to determine the start position from which is started the formation of an image to be transferred onto the second side of the sheet on the basis of the detected amounts of lateral registration deviation.

With reference to FIGS. 3 and 5 will be described the feature of the present invention, a method for adjusting the position of an image relative to a sheet in the case of two-sided image formation. First will be described a method for adjusting the start positions from which is started the formation of images to be transferred onto the second side of the sheet P (the positions on the photosensitive drums 11*a* to 11*d* from which is started the laser irradiation in the main scanning direction). When an image is formed on the second side of the sheet P, the sheet P is sent through the reversing portion. Therefore, the amount of deviation is considered to be large. In view of this, a method of adjustment when an image is formed on the second side of the sheet P will be described first. A method of adjustment when an image is formed on the first side of the sheet P will be described thereafter.

FIG. 3 illustrates the amount of lateral registration deviation and the computed value. Let us denote the amount of lateral registration deviation of a sheet when an image is formed on the first side thereof by $\alpha$, and the amount of lateral registration deviation of the same sheet when an image is formed on the second side thereof by $\beta$. In addition, let us denote the amount of lateral registration deviation of the second side of the same sheet before forming an image thereon relative to the first side by $\gamma$, and the amount of lateral registration deviation before forming an image on the second side obtained by computation in the control unit 70 by $\beta'$.

FIG. 5 is a flowchart showing how to determine the start position from which is started the formation of an image to be transferred onto the second side of the sheet P (how to adjust the image position) on the basis of the detected amounts of lateral registration deviation in the control unit 70. The case of the first sheet of a print job in which image formation on a plurality of sheets is continuously performed and the case of the second or more sheet (the nth sheet) of the print job will be separately described.

First, in the case of the nth sheet of the print job, control is performed as follows.

As described above, the nth sheet P of the print job fed from one of the paper cassettes 21*a* and 21*b* and the manual feed tray 27 is sent to the lateral registration detecting portion 700 located on the feeding path 24 (S8 (step will hereinafter be denoted as S)). The lateral registration detecting portion 700 detects the amount $\alpha_n$ of lateral registration deviation from the reference position of the sheet P when an image is formed on the first side thereof (S9). The amount $\alpha_n$ of lateral registration deviation is stored in the storage medium (memory) M. Next, the control unit 70 computes the amount $\beta'_n$ of lateral registration deviation when an image is formed on the second side of the nth sheet P. This amount $\beta'_n$ of lateral registration deviation is computed using the amount $\alpha_n$ of lateral registration deviation detected by the lateral registration detecting portion 700, and the amount $\gamma_{n-1}$ of lateral registration deviation of the second side of the (n−1)th sheet (the previous sheet) before forming an image thereon relative to the first side, from the equation $\beta'_n=\alpha_n+\gamma_{n-1}$(S10). When images to be transferred onto the second side of the nth sheet P are formed in the image forming portion, the timing (position) of irradiation to each of the photosensitive drums 11*a* to 11*d* by each of the optical systems 13*a* to 13*d* is changed from the reference position by the computed amount $\beta'_n$ of lateral registration deviation (S11). On the photosensitive drums 11*a* to 11*d* are formed toner images shifted by $\beta'_n$ in the main scanning direction. The toner images are primary-transferred onto the intermediate transfer belt 31 from the photosensitive drums 11*a* to 11*d*.

Onto the nth sheet P of the print job are transferred the toner images in the secondary transfer region Te. The toner images are fixed in the fixing unit 40. The nth sheet P is reversed by the forward reverse drive of the external eject roller 45 and the switching flapper 166, is sent to the double-sided path 240, and again reaches the registration roller pair 25*a* and 25*b* with the first side down. Onto the second side of the nth sheet P are transferred the images shifted by the calculated amount $\beta'_n$ of lateral registration deviation in the secondary transfer region Te. Thereafter, the toner images are fixed to the nth sheet P in the fixing unit 40, and the nth sheet P is ejected via the external eject roller 45 onto the paper output tray 48 outside the apparatus.

As described above, the nth sheet P of the print job is reversed in the reversing portion to form an image on the second side thereof, and again reaches the registration roller pair 25*a* and 25*b* via the double-sided path 240. At this time, the lateral registration detecting portion 700 detects the amount $\beta_n$ of lateral registration deviation from the reference value of the second side of the sheet P (S12). This detected amount $\beta_n$ of lateral registration deviation is stored in the storage medium M. At this time, the difference $\gamma_n$ between the amounts of lateral registration deviation of the first and second sides of the nth sheet P is computed from the equation $\gamma_n=\beta_n-\alpha_n$ by the control unit 70 (S13). This computational result, the difference $\gamma_n$ is used for adjusting the positions of images to be transferred onto the second side of the next (n+1)th sheet of the print job.

In this way, the positions of images to be transferred onto the second side of a sheet are adjusted on the basis of the difference in the side edge position between the first and second sides of the previous sheet. This control is performed until this job is completed (S14).

That is, after images are formed on the first and second sides of the (n−1)th sheet (sheet 1) and when an image is formed on the second side of the nth sheet (sheet 2), the image position is adjusted on the basis of the side edge position of the (n−1)th sheet (sheet 1). First, the lateral registration detecting portion 700 detects the side edge position of the (n−1)th sheet (sheet 1) when the sheet is fed by the sheet feeding portion (feeding path 24), and the side edge position of the same sheet when the sheet is conveyed by the sheet re-conveying portion (double-sided path 240). On the basis of the detection results of the side edge positions of the (n−1)th sheet (sheet 1), the side edge position of the next nth sheet (sheet 2) when an image is formed on the second side thereof is computed. On the basis of the computed side edge position of the nth sheet, the image position is adjusted.

In the case of the first sheet of a print job in which image formation on a plurality of sheets is continuously performed, control is performed as follows.

The conveyance of the sheet P is the same as that in the case of the nth sheet of the print job. Therefore, the description thereof will be omitted. This case differs in the method for calculating the amount $\beta'_1$ of lateral registration deviation of the second side of the sheet P in the control unit 70.

First, at the start of the print job (S1), the amount $\alpha_1$ of lateral registration deviation of the sheet P before forming an image on the first side thereof is detected (S2). The amount $\beta'_1$ of lateral registration deviation is computed using the amount $\alpha_1$ of lateral registration deviation of the sheet P before forming an image on the first side thereof, and the amount $\gamma_L$ of lateral registration deviation of the last sheet (the last sheet on which an image is formed) of the previous print job, from the equation $\beta'_1=\alpha_1+\gamma_L$ (S3). On the basis of this computational result, when images to be transferred onto the second side of the first sheet P of the print job are formed, the timing of irradiation to each of the photosensitive drums 11*a* to 11*d* by each of the optical systems 13*a* to 13*d* is changed from the reference position by the amount $\beta'_1$ of lateral registration deviation (S4). Therefore, on the photosensitive drums 11*a* to 11*d* are formed toner images shifted by $\beta'_1$. The toner images are primary-transferred onto the intermediate transfer belt 31 from the photosensitive drums 11*a* to 11*d*.

That is, when an image is formed on the second side of the first sheet of the print job (sheet 2), the image position is adjusted on the basis of the side edge position of the last sheet of the previous print job (sheet 1). First, the lateral registration detecting portion 700 detects the side edge position of the last sheet of the previous print job (sheet 1) when the sheet is fed by the sheet feeding portion (feeding path 24), and the side edge position of the same sheet when the sheet is conveyed by the sheet re-conveying portion (double-sided path 240). On the basis of the detection results of the side edge positions of the last sheet of the previous print job (sheet 1), the side edge position of the first sheet of the present print job (sheet 2) when an image is formed on the second side thereof is computed. On the basis of the computed side edge position of the first sheet of the print job, the image position is adjusted.

The first sheet P of the print job is reversed in the reversing portion to form an image on the second side thereof, and again reaches the registration roller pair 25*a* and 25*b* via the double-sided path 240. At this time, the lateral registration detecting portion 700 detects the amount $\beta_1$ of lateral registration deviation from the reference value of the second side of the sheet P (S5). This detected amount $\beta_1$ of lateral registration deviation is stored in the storage medium M. At this time, the difference $\gamma_1$ between the amounts of lateral registration deviation of the first and second sides of the sheet P is computed from the equation $\gamma_1=\beta_1-\alpha_1$ by the control unit 70 (S6). In the case of a job of two or more sheets (S7), the value of $\gamma_1$ is used for the next sheet.

Figure 6:
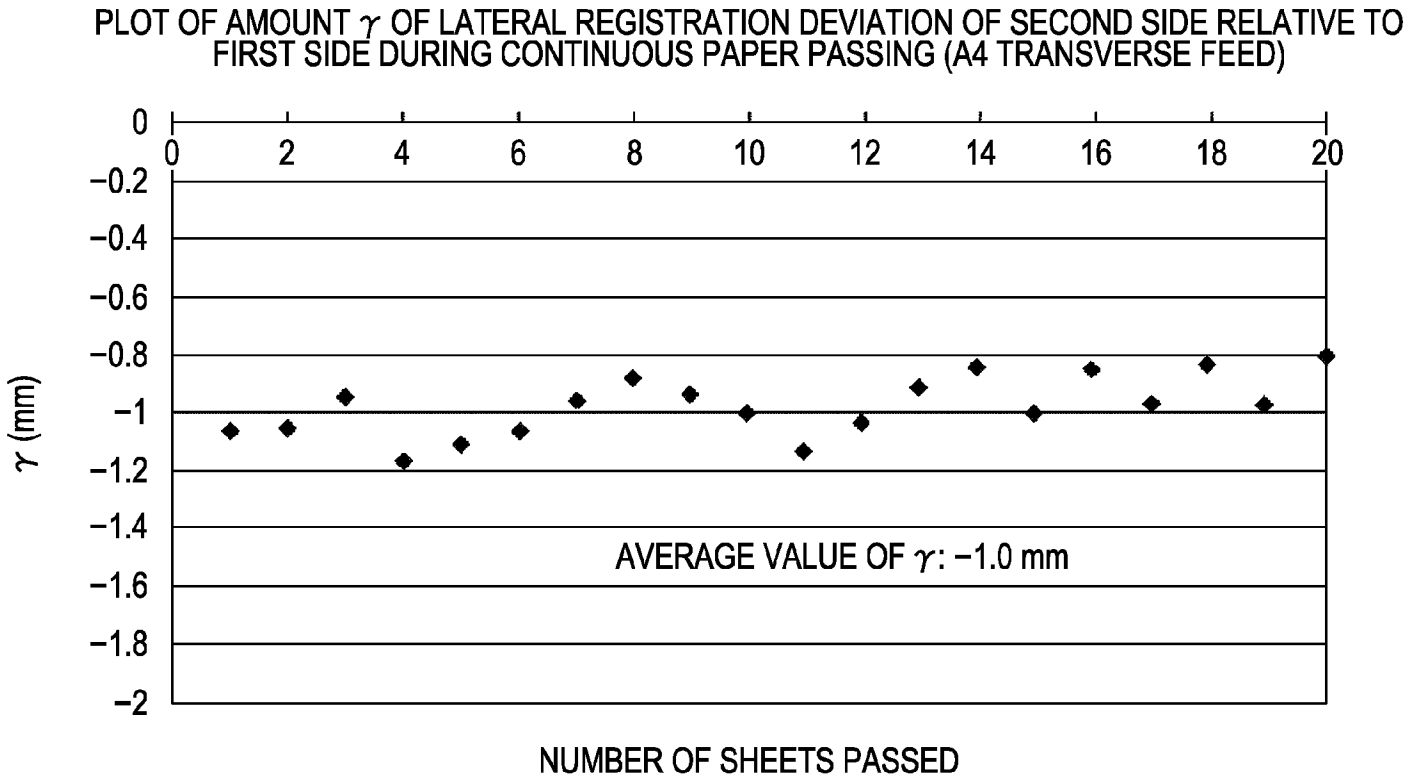
FIG. 6 shows an experimental result of the amount of lateral registration deviation of the second side relative to the first side when A4 sheets are fed transversely.

FIG. 6 shows the experimental result of the amount $\gamma$ of lateral registration deviation of the second side of the sheet P relative to the first side of the sheet P when the present invention was used in an actual image forming apparatus. The size of sheets used in the experiment was A4 size. Image formation was performed continuously on 20 sheets fed transversely (with the short edges parallel to the sheet conveying direction).

As shown in FIG. 6, the difference in $\gamma$ between two successive sheets was about 0.2 mm at a maximum. Therefore, when the amount of lateral registration deviation of the second side of a sheet is computed using $\gamma$ of the previous sheet (on which image formation is performed), the error is about 0.2 mm. Therefore, the lateral registration deviation can be corrected so that the positions of images on both sides can be substantially identical.

As described above, in this embodiment, when an image is formed on the second side of a sheet, the image forming position is adjusted on the basis of a value calculated using the amount $\alpha_n$ of lateral registration deviation detected before forming an image on the first side thereof and the amount $\gamma_{n-1}$ of lateral registration deviation of the previous sheet on which image formation is performed. In this way, the positional accuracy of the image formed on the second side of a sheet can be improved. The positions of images on both sides are substantially identical. Therefore, when a plurality of sheets on both sides of which images are formed are bound to make a book, the visual quality of the book is high. In addition, adjustment of the image forming position can be started significantly earlier compared to the known image forming apparatus in which the image forming position is adjusted after the edge is detected by the edge detecting sensor 800 provided on the double-sided path 240. That is, it is possible to adjust the positions of irradiation of laser light to the photosensitive drums 11*a* to 11*d* and to start forming the second-side images as soon as the first-side images have been primary-transferred onto the intermediate transfer belt 31. Therefore, the productivity of image formation can be improved.

In the image unit 10, the position where is formed an image to be transferred onto the first side of the nth sheet P of the print job, is adjusted as follows. Since the sheet during image formation on the first side thereof is sent by the sheet feeding portion (feeding path 24), the amount of deviation during conveyance of the sheet can be reduced by adjusting, for example, a guide. Therefore, when the amount of deviation is small, the image position need not be adjusted.

The position where is formed an image to be transferred onto the first side of the nth sheet P of the print job is adjusted by changing the position from the reference position by the amount $\alpha_{n-1}$ of lateral registration deviation of the (n−1)th sheet of the print job, which is detected by the lateral registration detecting portion 700 before image formation on the first side of the sheet P. That is, when the optical systems 13*a* to 13*d* irradiate the photosensitive drums 11*a* to 11*d*, respectively, with laser light, each irradiation position is changed from the reference position by the amount $\alpha_{n-1}$ of lateral registration deviation.

That is, after images are formed on the first and second sides of the (n−1)th sheet (sheet 1) and when an image is formed on the first side of the nth sheet (sheet 2), the image position is adjusted on the basis of the side edge position of the (n−1)th sheet (sheet 1). The lateral registration detecting portion 700 detects the side edge position of the (n−1)th sheet (sheet 1) during feeding by the sheet feeding portion (feeding path 24). On the basis of the detection results of the side edge positions of the (n−1)th sheet (sheet 1), the side edge position of the nth sheet (sheet 2) when an image is formed on the first side thereof is computed. On the basis of the computed side edge position of the nth sheet, the image position is adjusted.

Although not shown, experimental results show that the difference between $\alpha_{n-1}$ of a sheet and $\alpha_n$ of the next sheet is about 0.2 mm. From these results, the above-described control can be performed. When a sheet and the next sheet are fed from the same paper cassette, the accuracy of positional adjustment is further improved. The reason is that, in the case of the same paper cassette, the positional deviation of the paper cassette relative to the image forming portion in a direction perpendicular to the sheet conveying direction due to variation in accuracy of positioning components, causes an almost constant amount of lateral registration deviation.

As described above, during a print job, the image position when an image is formed on the first side of the present sheet (sheet 2) is adjusted on the basis of the amount of lateral registration deviation detected before forming an image on the first side of the previous sheet (sheet 1). The image position when an image is formed on the second side of the present sheet (sheet 2) is adjusted on the basis of the difference between the amount of lateral registration deviation detected before forming an image on the first side of the previous sheet (sheet 1) and the amount of lateral registration deviation detected before forming an image on the second side of the sheet.

As for the image formation on the first sheet of the print job, the position of an image to be transferred onto the first side of the first sheet (sheet 2) is adjusted on the basis of the amount of lateral registration deviation detected before forming an image on the first side of the last sheet of the previous print job (sheet 1). The position of an image to be transferred onto the second side of the first sheet (sheet 2) is adjusted as follows. That is, the adjustment is performed on the basis of the difference between the amount of lateral registration deviation detected before forming an image on the first side of the last sheet of the previous print job (sheet 1) and the amount of lateral registration deviation detected before forming an image on the second side of the last sheet.

Thus, high-productivity image formation can be performed without reducing positional accuracy of images relative to sheets.

In the above embodiment, the amount $\beta'_1$ of lateral registration deviation of the second side of the first sheet of a print job is computed using the amount $\gamma_L$ of lateral registration deviation of the last sheet of the previous job. However, there is the following alternative.

With respect to each width size or each kind of sheet, the amount $\gamma_L$ of lateral registration deviation of the last sheet of a print job is stored in the storage medium M. For each print job, the amount $\gamma_L$ of lateral registration deviation of the corresponding width size or kind of sheet stored in the storage medium M is referred to, and on the basis of it, the image position is adjusted.

Figure 7:
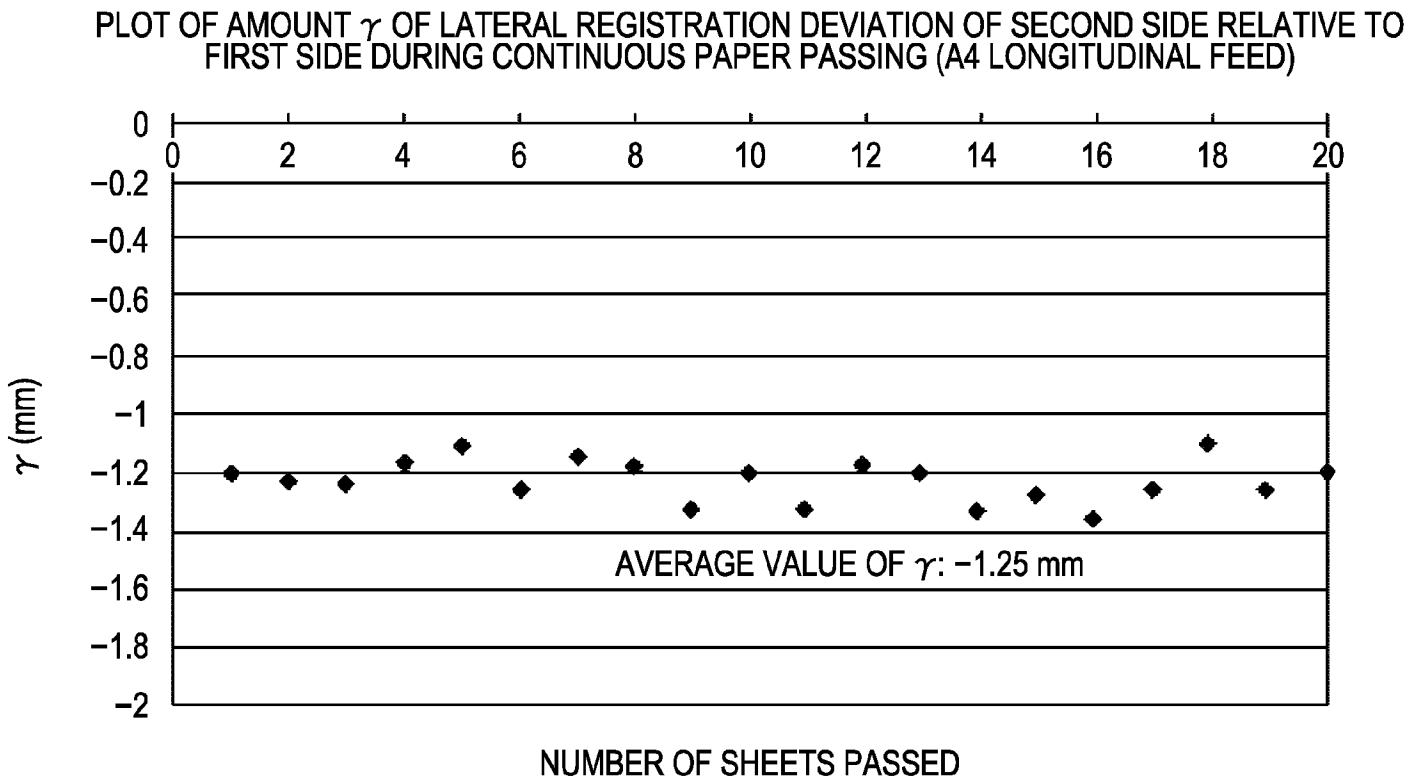
FIG. 7 shows an experimental result of the amount of lateral registration deviation of the second side relative to the first side when A4 sheets are fed longitudinally.

FIG. 7 shows an experimental result in which are plotted the amounts γ of lateral registration deviation of the second side of the sheet P relative to the first side of the sheet P when 20 A4 sheets that are the same as those used in the experiment of FIG. 6 are fed longitudinally (with the long edges parallel to the sheet conveying direction).

The average value of the amount γ of lateral registration deviation in FIG. 6 is −1.0 mm. The average value of the amount γ of lateral registration deviation in FIG. 7 is −1.25 mm. The difference is 0.25 mm. This shows that the amount of lateral registration deviation of the second side of the sheet P relative to the first side of the sheet P depends on the sheet size in the direction perpendicular to the sheet conveying direction (width size). Therefore, optimum adjustment can be performed by storing the amount $\gamma_L$ of lateral registration deviation of the last sheet of a print job with respect to each width size in the storage medium M, and computing with reference to the amount $\gamma_L$ of lateral registration deviation of the corresponding width size.

Figure 8:
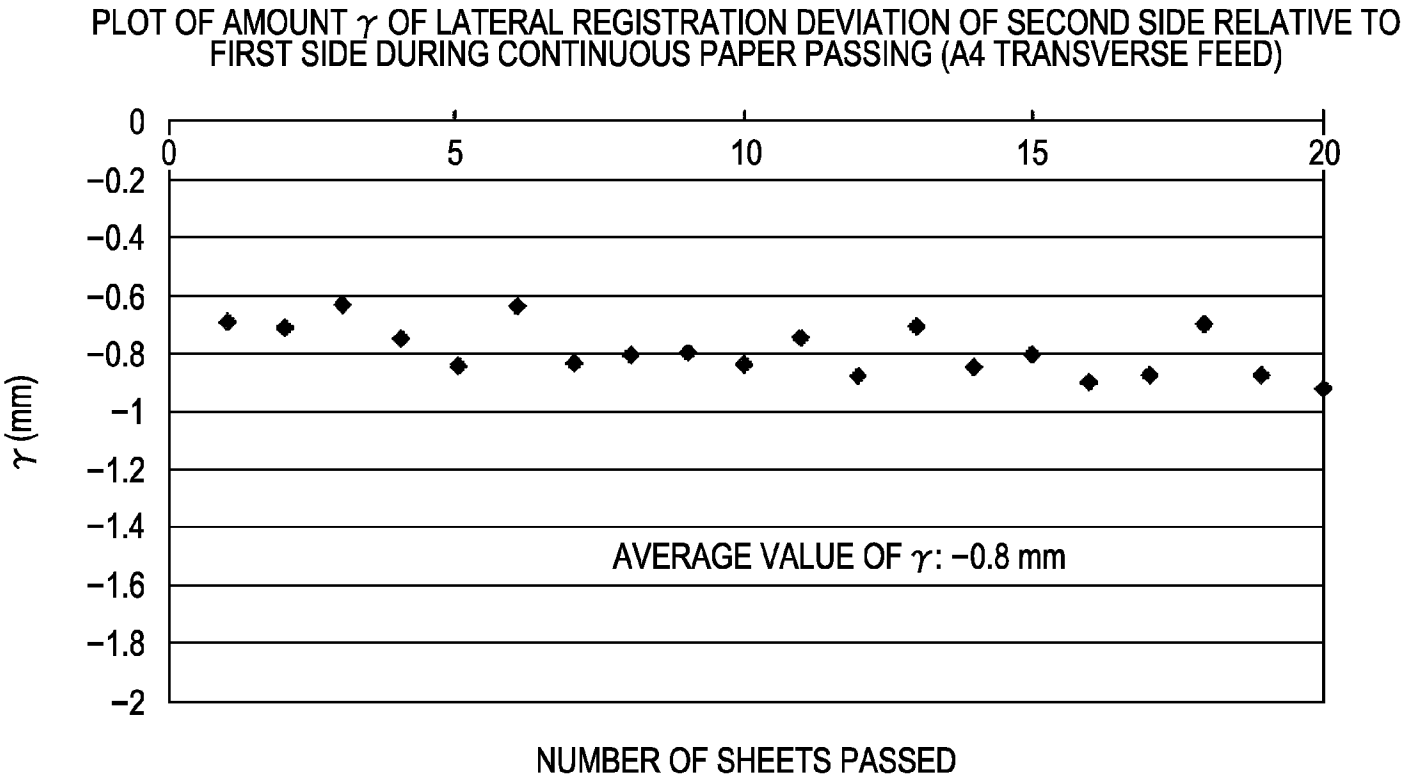
FIG. 8 shows an experimental result of the amount of lateral registration deviation of the second side relative to the first side when A4 sheets that differ in kind from those of FIG. 6 are fed transversely.
Figure 9:
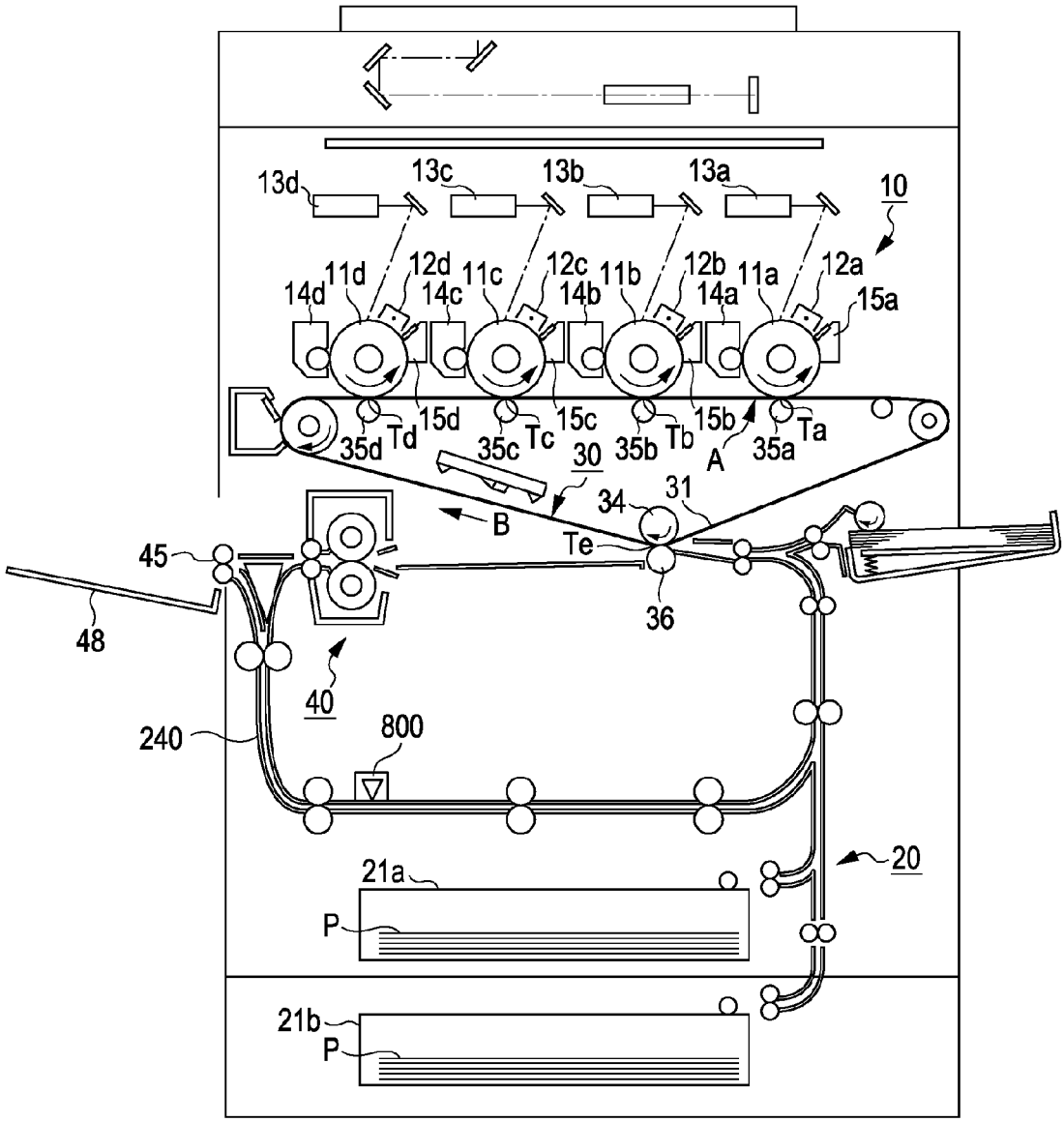
FIG. 9 is a schematic sectional view showing an example of a known color image forming apparatus provided with an edge position detecting unit.

FIG. 8 shows an experimental result in which are plotted the amounts γ of lateral registration deviation of the second side of the sheet P relative to the first side of the sheet P when 20 A4 sheets that differ in kind from those used in the experiment of FIG. 6 are fed transversely. The average value of the amount γ of lateral registration deviation in FIG. 8 is −0.8 mm. Compared to the experimental result of FIG. 6, there is a difference of 0.2 mm. This shows that the amount of lateral registration deviation of the second side of the sheet P relative to the first side of the sheet P depends on the kind of sheet. Therefore, optimum adjustment according to the kind of sheet can be performed by storing the amount $\gamma_L$ of lateral registration deviation of the last sheet of a print job with respect to each kind of sheet in the storage medium M, and computing with reference to the amount $\gamma_L$ of lateral registration deviation of the corresponding kind of sheet. Storing the amount $\gamma_L$ of lateral registration deviation with respect to each combination of the width size and the kind of sheet in the storage medium M and performing adjustment on the basis thereof achieve further improvement in positional accuracy of images.

In this embodiment, a photosensor serves as a lateral registration detecting sensor and detects the side edge position of a sheet. However, the present invention is not limited to this. The edge of a sheet may also be detected, for example, by a flag sensor or a line sensor. The number and location of the lateral registration detecting sensors 701 are not limited to one and upstream of the registration roller pair 25*a* and 25*b*, respectively. For example, it is possible to dispose a lateral registration detecting sensor for the first side of a sheet downstream of each paper cassette, and a lateral registration detecting sensor for the second side of a sheet on the double-sided path 240. In this case, the detection result of the lateral registration detecting sensor disposed on the double-sided path 240 is used not for adjustment of the image forming position of the detected sheet but for adjustment of the image forming position of the next sheet.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-165227 filed Jun. 22, 2007, which is hereby incorporated by reference herein in its entirety.

What is claimed is:

1. An image forming apparatus that forms an image on a sheet, the image forming apparatus comprising: an image forming portion that forms an image on a sheet, having an intermediate transfer belt onto which a toner image formed on a photosensitive drum is primary-transferred and a secondary transfer device which transfers the toner images formed on the intermediate transfer belt onto the sheet;

a sheet feeding portion that feeds a sheet from a sheet storing portion that stores sheets, to the image forming portion through a feeding path; a registration roller pair that conveys the sheet fed by the sheet feeding portion to the image forming portion;

a sheet re-conveying portion that conveys a sheet on a first side of which an image has been formed in the image forming portion, to the image forming portion to form an image on a second side of the sheet through a re-conveying path; an edge position detecting sensor, disposed upstream of the registration roller pair and downstream of a confluence of the feeding path and the re-conveying path, configured to detect a first side edge position along a sheet feeding direction of a sheet fed to the image forming portion by the sheet feeding portion and to detect a second side edge position along a sheet conveying direction of a sheet conveyed to the image forming portion by the sheet re-conveying portion; and a control portion configured to adjust, after images are formed on a first side and a second side of a first sheet and based on a detected first side edge position of the first sheet fed by the sheet feeding portion, a detected second side edge position of the first sheet conveyed by the sheet re-conveying portion detected by the edge position detecting sensor, and a detected first side edge position of a second sheet fed by the sheet feeding portion, an image position of an image of the image forming portion to be formed on a second side of the second sheet, wherein, for each set of a first and second consecutive sheet in a job, the control portion:

computes, as a computed difference, a difference between a detected first side edge position of the first sheet fed by the sheet feeding portion and a detected second side edge position of the first sheet conveyed by the sheet re-conveying portion detected by the edge position detecting sensor, computes, by adding the computed difference to a detected first side edge position of the second sheet fed by the sheet feeding portion, a computed second side edge position in the image forming portion of the second sheet conveyed by the sheet re-conveying portion, and adjusts the image position of the image to be formed on the second side of the second sheet based on the computed second side edge position in the image forming portion of the second sheet.

2. The image forming apparatus according to claim 1, wherein the control portion stores the detected first side edge position of the first sheet fed by the sheet feeding portion and detected by the edge position detecting sensor, and adjusts an image position of an image to be formed on a first side of the second sheet based on the stored detected first side edge position of the first sheet.

3. The image forming apparatus according to claim 1, wherein, in response to images being formed on the first sheet of a job in which image formation is performed continuously on a plurality of sheets, the control portion adjusts an image position of an image to be formed on a second side of the first sheet, based on a detected first side edge position of a last sheet of a previous job fed by the sheet feeding portion and a detected second side edge position of the last sheet conveyed by the sheet re-conveying portion.

4. The image forming apparatus according to claim 1, wherein the control portion stores an amount of adjustment of image position obtained based on a first side edge position of a last sheet of each job fed by the sheet feeding portion and a second side edge position of the last sheet fed by the sheet re-conveying portion with respect to each width size or each kind of sheet, and adjusts an image position of an image to be formed on a second side of the first sheet of a job based on the stored amounts of adjustment in accordance with the width size or kind of sheet.

5. The image forming apparatus according to claim 1, wherein, in response to images being formed on the first sheet of a job in which image formation is performed continuously on a plurality of sheets, the control portion adjusts an image position of an image to be formed on a first side of the first sheet, based on a detected first side edge position of a last sheet of a previous job fed by the sheet feeding portion and detected by the edge position detecting sensor.

6. The image forming apparatus according to claim 1, wherein the control portion stores an amount of adjustment of image position obtained based on a first side edge position of a last sheet of each job fed by the sheet feeding portion with respect to each width size or each kind of sheet, and adjusts an image position of an image to be formed on a first side of the first sheet of a job based on the stored amounts of adjustment in accordance with the width size or kind of sheet.

7. The image forming apparatus according to claim 1, wherein the control portion adjusts the image position of the image of the image forming portion based on detection by no more than one sensor, wherein the no more than one sensor is the edge position detecting sensor.

* * * * *